United States Patent [19]

Morgan

[11] 4,070,973

[45] Jan. 31, 1978

[54] MECHANIZED DISPLAY DEVICE

[76] Inventor: Jerome Morgan, 602 E. Kirby, Detroit, Mich. 48202

[21] Appl. No.: 687,884

[22] Filed: May 19, 1976

[51] Int. Cl.[2] ..... A47D 5/025

[52] U.S. Cl. ..... 108/20; 40/474; 211/1.5; 211/131; 211/144; 211/163

[58] Field of Search ..... 211/1.5, 53, 56, 58, 211/70, 77, 78, 95, 129, 131, 144, 163; 40/33, 34, 125 D; 108/20, 94, 103

[56] References Cited

U.S. PATENT DOCUMENTS

| | | | |
|---|---|---|---|
| 74,633 | 2/1868 | Tice | 211/163 |
| 764,307 | 7/1904 | Scahill | 108/20 X |
| 1,391,583 | 9/1921 | Sachs | 108/20 |
| 2,673,778 | 3/1954 | Wood | 40/33 X |
| 2,736,628 | 2/1956 | Fadden | 211/1.5 X |
| 2,750,051 | 6/1956 | Wassell | 211/78 X |
| 3,339,744 | 9/1967 | Ginsberg | 211/1.5 |
| 3,381,399 | 5/1968 | Drueck | 40/33 |
| 3,399,781 | 9/1968 | Nalbandian | 211/1.5 |
| 3,847,285 | 11/1974 | Leprince | 211/1.5 |
| 3,887,786 | 6/1975 | Wittetal | 211/163 X |

FOREIGN PATENT DOCUMENTS

| | | | |
|---|---|---|---|
| 1,101,742 | 4/1955 | France | 108/20 |
| 456,726 | 6/1926 | Germany | 108/20 |

*Primary Examiner*—Roy D. Frazier
*Assistant Examiner*—Thomas J. Holko
*Attorney, Agent, or Firm*—Bacon & Thomas

[57] ABSTRACT

A mechanized display for articles, such as cigarette packages, includes rotating platforms upon which the packages rest. The rotating platforms are supported in openings through a plastic housing by drive shaft means, which is driven with a battery powered electric motor. The battery powered electric motor is retained in the bottom of the plastic housing, so that the housing can either sit stably on a flat surface or be suspended from its top.

12 Claims, 3 Drawing Figures

MECHANIZED DISPLAY DEVICE

BACKGROUND OF THE INVENTION

1. Field of the Invention

This invention relates to motorized displays. More particularly, this invention relates to light weight motorized displays, which are relatively inexpensive and can be produced in vast numbers.

2. Technical Considerations and Prior Art

In advertising articles, such as cigarettes, it is frequently desirable to display several brands produced by a single manufacturer in a unified group. Preferably, the display should be appealing and should be interesting, so as to attract attention. One way to attract attention is to have the products on display move.

Ordinarily, when displaying cigarettes, an actual pack of cigarettes is used. If the display is on a store counter, or is readily accessible to store customers, the cigarettes are frequently stolen. Consequently, store proprietors tend to move the display to an inaccessible area, where the display is not so effective.

When advertising products, such as cigarettes, it is necessary to have a vast number of displays, so that the displays can be set up in thousands of retail outlets. The displays, consequently, have to be inexpensive and uniform in appearance. In addition, the displays should be relatively sturdy, so that they can withstand abuse, and should allow frequent and easy change of the cigarette packages being advertised. Preferably, the display should utilize emply cigarette packages, in order to discourage theft, which frequently results in the effectiveness of the display being compromised.

OBJECTS OF THE INVENTION

In view of the foregoing consideration, it is an object of the invention to provide a new and improved light weight inexpensive display.

It is further object of the instant invention to provide a new and improved display for products, such as cigarettes.

It is still a further object of the instant invention to provide a new and improved display for articles, such as cigarettes, wherein the display is motorized so that the product will move within the display.

SUMMARY OF THE INVENTION

In view of the foregoing objects of the invention, the instant invention contemplates a light weight display, in which a product or product package is secured to a rotating platform supported within openings through a hollow plastic housing. The platform is driven to rotate by a shaft means, which is also supported within the housing. The shaft means is driven by a battery powered electric motor positioned in the bottom of the housing. If desired, a plurality of platforms may be supported for rotation within a single plastic housing.

DETAILED DESCRIPTION

Figure 1:
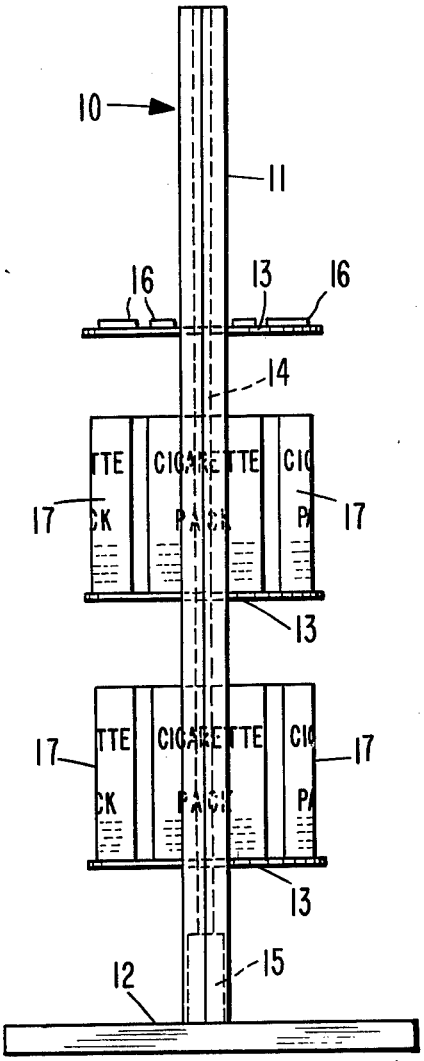
FIG. 1 is a side view of a display, in accordance with the instant invention.
Figure 2:
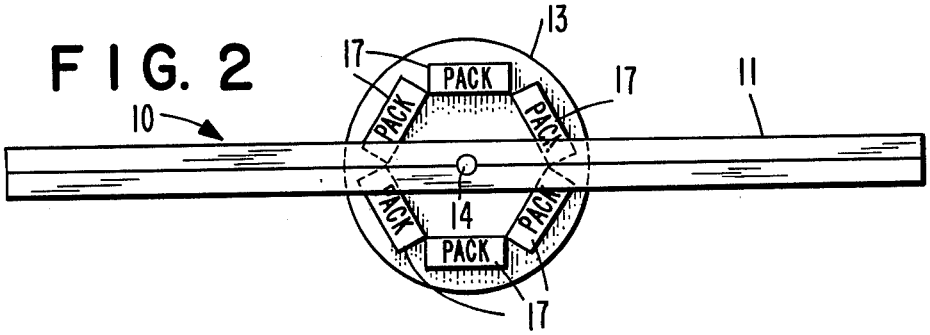
FIG. 2 is a top view of the display, shown in FIG. 1.
Figure 3:
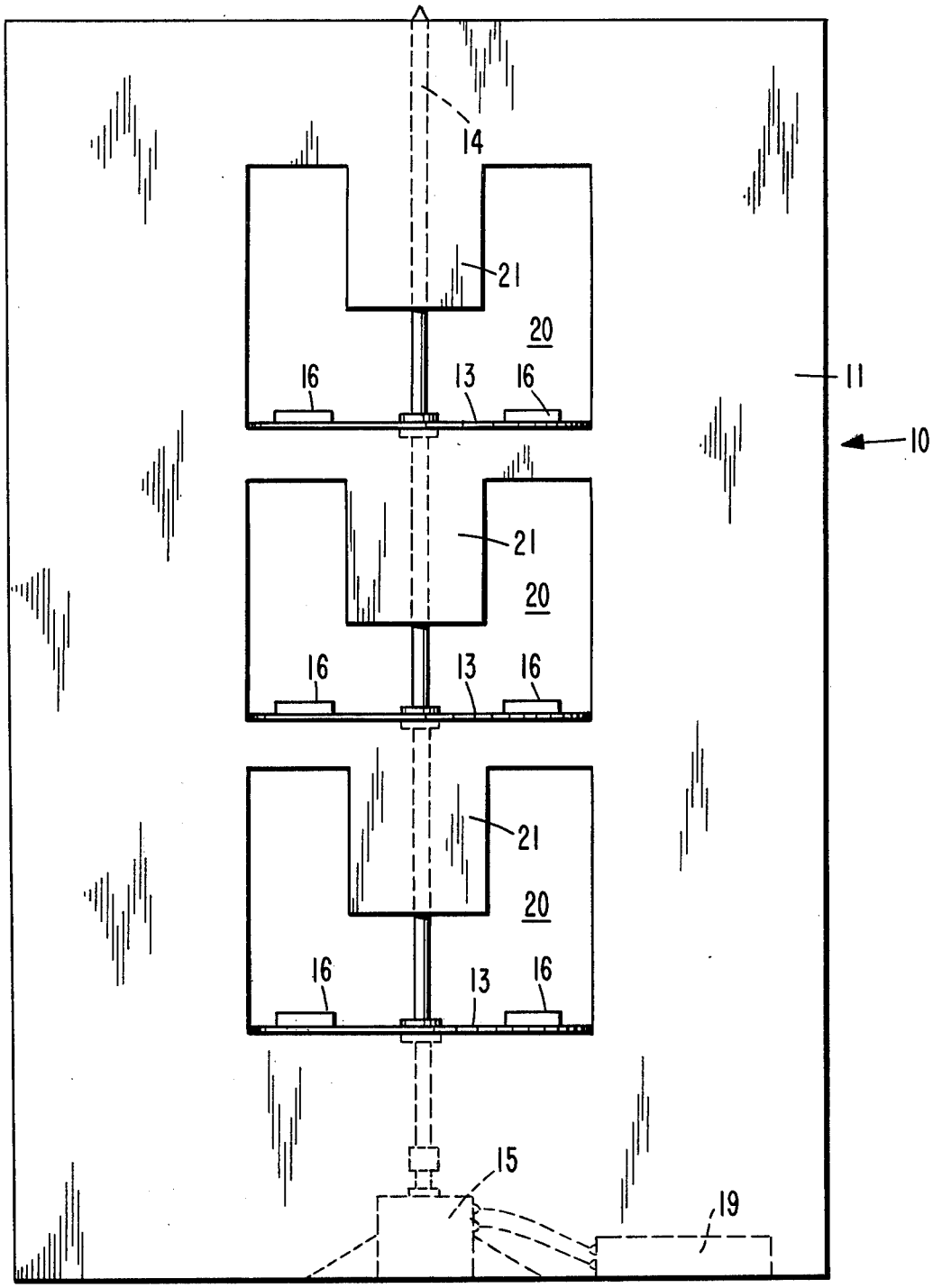
FIG. 3 is a front view of the display, shown in FIGS. 1 and 2.

Referring now to FIGS. 1, 2 and 3, there is shown a display, generally designated by the numeral 10, which includes a housing 11 that is supported by a base 12 on a planar surface, such as a counter top or the like. Supported for rotation in the housing 11 is a plurality of circular platforms 13. The platforms 13 are rotated by a shaft 14 driven by a small electric motor 15. The motor 15 is powered by a battery 16.

Both the motor 15 and battery 16 are held in the bottom of the housing 11 with any convenient means. For example, the motor and battery may be held in place by an adhesive, clamp members or straps secured over the motor and battery and attached to the housing.

The housing is preferably made of a light weight plastic material, which is relatively thin in cross section. Preferably, the plastic housing is manufactured in two sections, which are then snapped together in a well-known manner. For example, one half of the housing may have recesses and the other half of the housing may have detents, which snap into the recesses. Since the housing is light weight, the battery and motor supply enough weight to give the display a low center of gravity, so that the display can be stably supported on a flat surface.

Each of the rotating platforms 13 has upstanding flanges 16 thereon, which define rectangular recesses into which fit cigarette packs 17. Preferably, the cigarette packs 17 are empty, so as to discourage theft. It should be kept in mind that other means may be used to secure the cigarette packages 17 on the platforms. Such other means may be an adhesive, recesses in the platforms 13 or projections extending from the platforms 13, which slide into the packs 17.

As is seen in FIG. 3, the platforms 13 rotate in openings 20 through the housing 11. The housing 11 has projections 21, which project into the openings 20, so that the openings have a U-shaped configuration. By having such an arrangement, the cigarette packs pass into and out of the customer's sight as the platforms 13 rotate.

Figure 4:
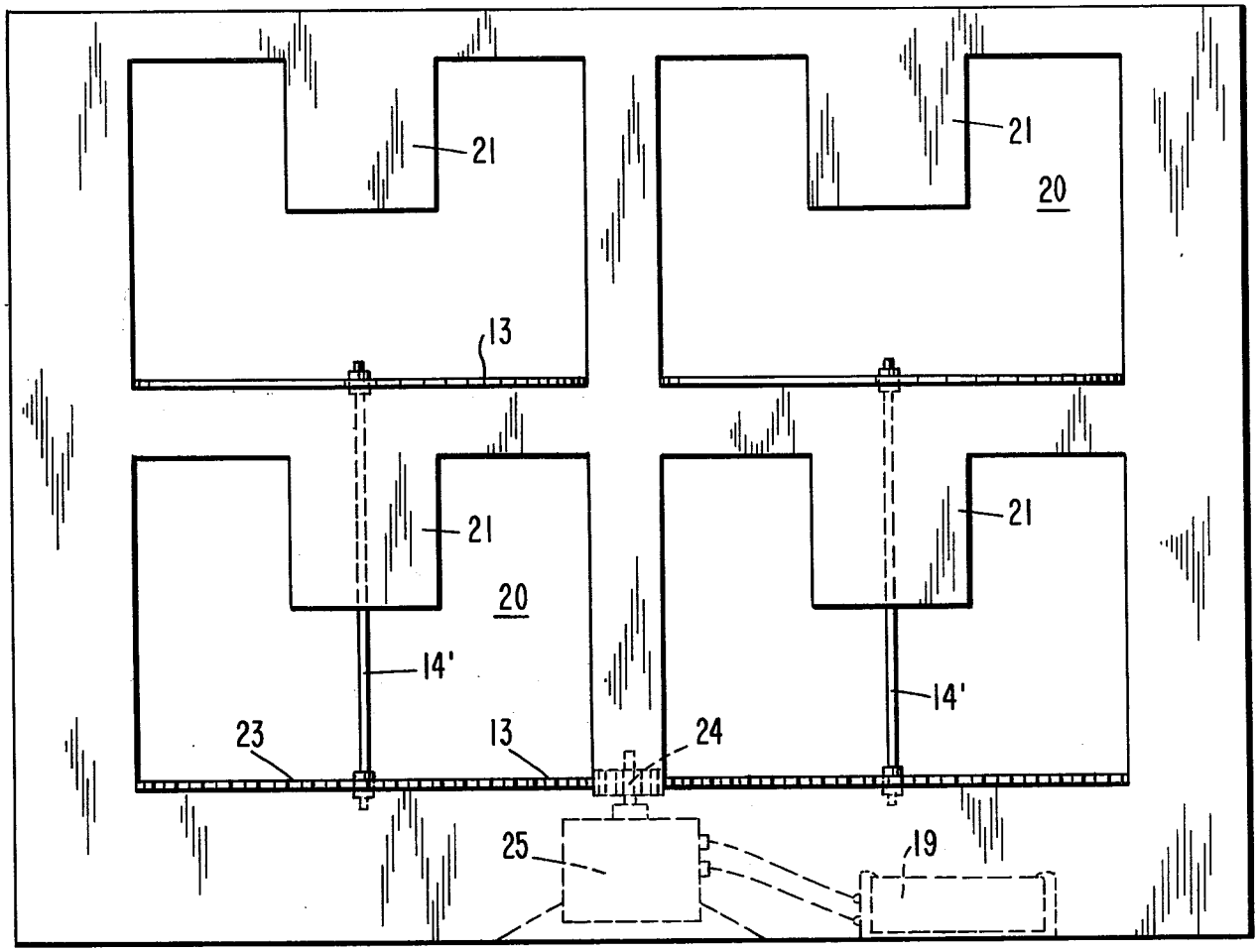
FIG. 4 is a front view of a second embodiment of the display, according to the instant invention.

While three platforms 13 are shown in FIGS. 1 and 3, it is of course possible to have any number of platforms 13. A preferred alternative is shown in FIG. 4, in which there are four platforms 13 with corresponding openings 20. In the configuration of FIG. 4, there are two shafts 14' which project from the bottom platforms 13. The bottom platforms 13 have gear teeth 23 which mesh with gear teeth on a pinion 24 driven by a motor 25. In the embodiment of FIG. 4, the platforms 13 rotate in the same direction.

In order to give the display 10 a longer operating life, the batteries may be recharged by an inexpensive photoelectric cell according to well-known techniques.

The foregoing illustrations are merely examples of the invention, which is to be limited only by the following appended claims:

What is claimed is:

1. A mechanized display device for advertising a product by displaying packages of the product, comprising:

at least one rotating, horizontally extending platform for supporting packages for the product;

shaft means fixed to and supporting said platform for rotation about an axis;

a substantially hollow housing extending vertically and having front and rear surfaces and an opening extending therethrough, wherein said platform is disposed in said opening and extends beyond the front and rear surfaces of the housing, said housing supporting said shaft means;

electric motor means disposed within said housing and beneath said platform for driving said shaft to rotate said platform in said opening and relative to said housing wherein, said platform means includes means thereon for retaining said packages, wherein said retaining means are arranged in a circular pattern around the axis of said shaft, and wherein said housing has a portion which projects from the top of said opening in the direction of said axis and into said opening, so that said opening is U-shaped with the packages revolving around the projecting portion when retained on said platform by said retaining means.

2. The display of claim 1 wherein said electric motor means is powered by a battery means disposed in said housing beneath said platform.

3. The mechanized display of claim 1 wherein the packages are cigarette packages and wherein the packages displayed are empty.

4. The mechanized display of claim 1, wherein there is a plurality of openings in said housing with a platform in each of said openings.

5. The mechanized display of claim 4, wherein a single shaft drives all of the platforms.

6. The mechanized display of claim 4, wherein the openings are disposed on opposite sides of the motor and wherein two of said openings have platforms therein which have gear teeth on the periphery thereof which mesh with a pinion gear driven by said motor.

7. The display device of claim 6, wherein the platforms on opposite sides of the motor each drive shafts, which rotate additional platforms disposed thereabove.

8. The mechanized display of claim 6 wherein the packages are cigarette packages and wherein the packages displayed are empty.

9. The display of claim 6 wherein said electric motor means is powered by a battery means disposed in said housing beneath said platform.

10. The mechanized display of claim 1, wherein the housing is formed of two identical halves, which are joined together to form the hollow enclosure which contains said shaft therein.

11. The mechanized display of claim 10 wherein the packages are cigarette packages and wherein the packages displayed are empty.

12. The display of claim 11 wherein said electric motor means is powered by a battery means disposed in said housing beneath said platform.

* * * * *